US007883133B2

(12) United States Patent
Chinn

(10) Patent No.: US 7,883,133 B2
(45) Date of Patent: Feb. 8, 2011

(54) APPARATUS AND METHODS FOR LITTER SUPPORT SYSTEM FOR VEHICLES

(75) Inventor: Robert Chinn, Cumming, GA (US)

(73) Assignee: Ferno-Washington, Inc., Wilmington, OH (US)

( * ) Notice: Subject to any disclaimer, the term of this patent is extended or adjusted under 35 U.S.C. 154(b) by 178 days.

(21) Appl. No.: 12/103,030

(22) Filed: Apr. 15, 2008

(65) Prior Publication Data

US 2009/0255058 A1 Oct. 15, 2009

(51) Int. Cl.
*A61G 1/06* (2006.01)

(52) U.S. Cl. ..... 296/19; 5/9.1; 5/118; 5/170; 105/315; 105/316; 244/118.5; 244/118.6

(58) Field of Classification Search ..... 5/8, 5/9.1, 118, 119, 136, 163, 170; 52/36.1, 52/36.4; 105/315, 316, 319, 321; 211/90.1, 211/150; 244/118.1, 118.2, 118.5, 118.6, 244/122 R, 137.2; 296/19, 20; 410/46, 102, 410/104

See application file for complete search history.

(56) References Cited

U.S. PATENT DOCUMENTS

| | | | | | |
|---|---|---|---|---|---|
| 269,985 | A * | 1/1883 | Adgate | 5/164.1 |
| 619,174 | A * | 2/1899 | Haskins | 105/315 |
| 1,178,360 | A * | 4/1916 | Tudor | 296/19 |
| 1,576,034 | A * | 3/1926 | Butt | 108/134 |
| 2,391,051 | A * | 12/1945 | Windsor | 5/9.1 |
| 2,456,024 | A * | 12/1948 | Schofield | 296/19 |
| 2,473,364 | A * | 6/1949 | Dickinson et al. | 5/9.1 |
| 2,480,322 | A * | 8/1949 | Cozzoli | 244/118.6 |
| 2,556,076 | A * | 6/1951 | Evans et al. | 5/9.1 |
| 2,685,912 | A * | 8/1954 | Evans et al. | 248/240.2 |
| 3,204,998 | A * | 9/1965 | Stollenwerk | 296/19 |
| 3,606,619 | A * | 9/1971 | Stollenwerk | 5/9.1 |
| 3,840,265 | A * | 10/1974 | Stirling et al. | 296/19 |
| 4,178,032 | A * | 12/1979 | Hone | 296/19 |
| 4,210,355 | A * | 7/1980 | Legueu | 296/19 |
| 4,378,128 | A | 3/1983 | Holling et al. | |
| 4,397,432 | A * | 8/1983 | Resetar | 244/118.6 |
| 4,425,978 | A * | 1/1984 | Star | 180/243 |
| 4,458,864 | A * | 7/1984 | Colombo et al. | 244/118.5 |
| 4,915,435 | A * | 4/1990 | Levine | 296/24.38 |
| 4,974,377 | A * | 12/1990 | Dominitz et al. | 52/143 |

(Continued)

FOREIGN PATENT DOCUMENTS

DE 3209092 A1 * 9/1983

(Continued)

*Primary Examiner*—Glenn Dayoan
*Assistant Examiner*—Paul A Chenevert
(74) *Attorney, Agent, or Firm*—Dinsmore & Shohl LLP

(57) ABSTRACT

A litter support system for a vehicle including a support framework connectable to a wall of the vehicle, an upper litter support arm for holding a litter, the upper litter support arm connected to the support framework, a lower litter support arm for holding a litter, the lower litter support arm connected to the support framework, wherein the upper and lower litter support arms are connected to the support framework such that the upper and lower litter support arms are rotatable between a store position and a first support position and movable substantially horizontally between the first support position substantially adjacent to and near the support framework and a second support position substantially extended outwardly from the support framework.

5 Claims, 21 Drawing Sheets

U.S. PATENT DOCUMENTS

| | | | | | |
|---|---|---|---|---|---|
| 5,372,339 | A | | 12/1994 | Morgan | |
| 5,383,629 | A | * | 1/1995 | Morgan | 244/118.6 |
| 5,490,703 | A | * | 2/1996 | Hewko | 296/19 |
| 5,615,848 | A | * | 4/1997 | Ceriani | 244/118.5 |
| 5,738,306 | A | * | 4/1998 | Moss et al. | 244/137.2 |
| 5,755,478 | A | * | 5/1998 | Kamiya et al. | 296/24.38 |
| 5,779,296 | A | * | 7/1998 | Hewko | 296/19 |
| 5,785,277 | A | * | 7/1998 | Manning et al. | 244/137.2 |
| 5,813,629 | A | * | 9/1998 | Cabrera | 244/118.6 |
| 6,273,366 | B1 | * | 8/2001 | Sprenger et al. | 244/118.5 |
| 6,585,188 | B2 | * | 7/2003 | Alli | 244/118.5 |
| 7,028,351 | B1 | | 4/2006 | Frieder et al. | |
| 7,097,204 | B2 | * | 8/2006 | Jessup et al. | 280/748 |
| 2008/0023976 | A1 | * | 1/2008 | Myers et al. | 296/19 |

FOREIGN PATENT DOCUMENTS

| | | | | |
|---|---|---|---|---|
| EP | 0021526 | A2 | | 1/1981 |
| EP | 0583491 | A1 | | 2/1994 |
| FR | 2481110 | A | | 10/1981 |
| FR | 2647323 | A1 | * | 11/1990 |
| FR | 2649007 | A1 | * | 1/1991 |
| GB | 1530794 | A | | 11/1978 |
| GB | 2401541 | A | | 11/2004 |
| WO | 9115178 | A1 | | 10/1991 |
| WO | 9927881 | A1 | | 6/1999 |
| WO | 0059446 | A1 | | 10/2000 |

* cited by examiner

APPARATUS AND METHODS FOR LITTER SUPPORT SYSTEM FOR VEHICLES

FIELD OF THE INVENTION

This patent relates to apparatus and methods for litter support systems. More particularly, this patent relates to apparatus and methods for adjustable litter support systems for a vehicle, such as an emergency vehicle.

BACKGROUND OF THE INVENTION

Injured or ill patients are many times carried and transported on litters. Rather than unload and load patients off and back on the litters while transporting them in emergency vehicles, the emergency personnel leave the patients on the litter and load both directly into the emergency vehicle for and during transportation of the patients. Thus, there is a continued need for systems to support, manipulate, and secure litters within vehicles, particularly emergency vehicles.

SUMMARY OF THE INVENTION

The present invention is directed to adjustable litter rack systems for a utility vehicle. One exemplary embodiment of the present invention includes a litter support system for a vehicle including a support framework connectable to a wall of the vehicle, an upper litter support arm for holding a litter, the upper litter support arm connected to the support framework, and a lower litter support arm for holding a litter, the lower litter support arm connected to the support framework. The upper and lower litter support arms are connected to the support framework such that the upper and lower litter support arms are rotatable between a store position and a first support position and movable substantially horizontally between the first support position substantially adjacent to and near the support framework and a second support position substantially extended outwardly from the support framework.

Another exemplary embodiment of the present invention includes a litter support system for a vehicle including a support framework connectable to a wall of the vehicle, an upper litter bed for holding a litter, the upper litter bed connected to the support framework, and a lower litter bed for holding a litter, the lower litter bed connected to the support framework. The upper and lower beds are connected to the support framework such that the upper and lower beds are rotatable between a store position and a first support position and movable substantially horizontally between the first support position and a second support position.

Another exemplary embodiment of the present invention include a litter support system for a vehicle including a plurality of vertical supports for attaching to a wall of the vehicle, a plurality of base frames connected to respective lower ends of the plurality of vertical supports, a plurality of upper biasing cylinders connected to respective ones of the plurality of vertical supports, a plurality of lower biasing cylinders connected to respective ones of the plurality of base frames, a plurality of upper connecting arms connected to respective ones of the plurality of vertical supports, a plurality of lower connecting arms connected to respective ones of the plurality of vertical supports, an upper litter bed for holding a litter, wherein the upper litter bed connected to the plurality of upper connecting arms and the plurality of upper biasing cylinders, and a lower litter bed for holding a litter, wherein the lower litter bed connected to the plurality of lower connecting arms and the plurality of lower biasing cylinders.

BRIEF DESCRIPTION OF THE DRAWINGS

While the specification concludes with claims particularly pointing out and distinctly claiming the invention, it is believed the same will be better understood from the following description taken in conjunction with the accompanying drawings in which:

Figure 1:
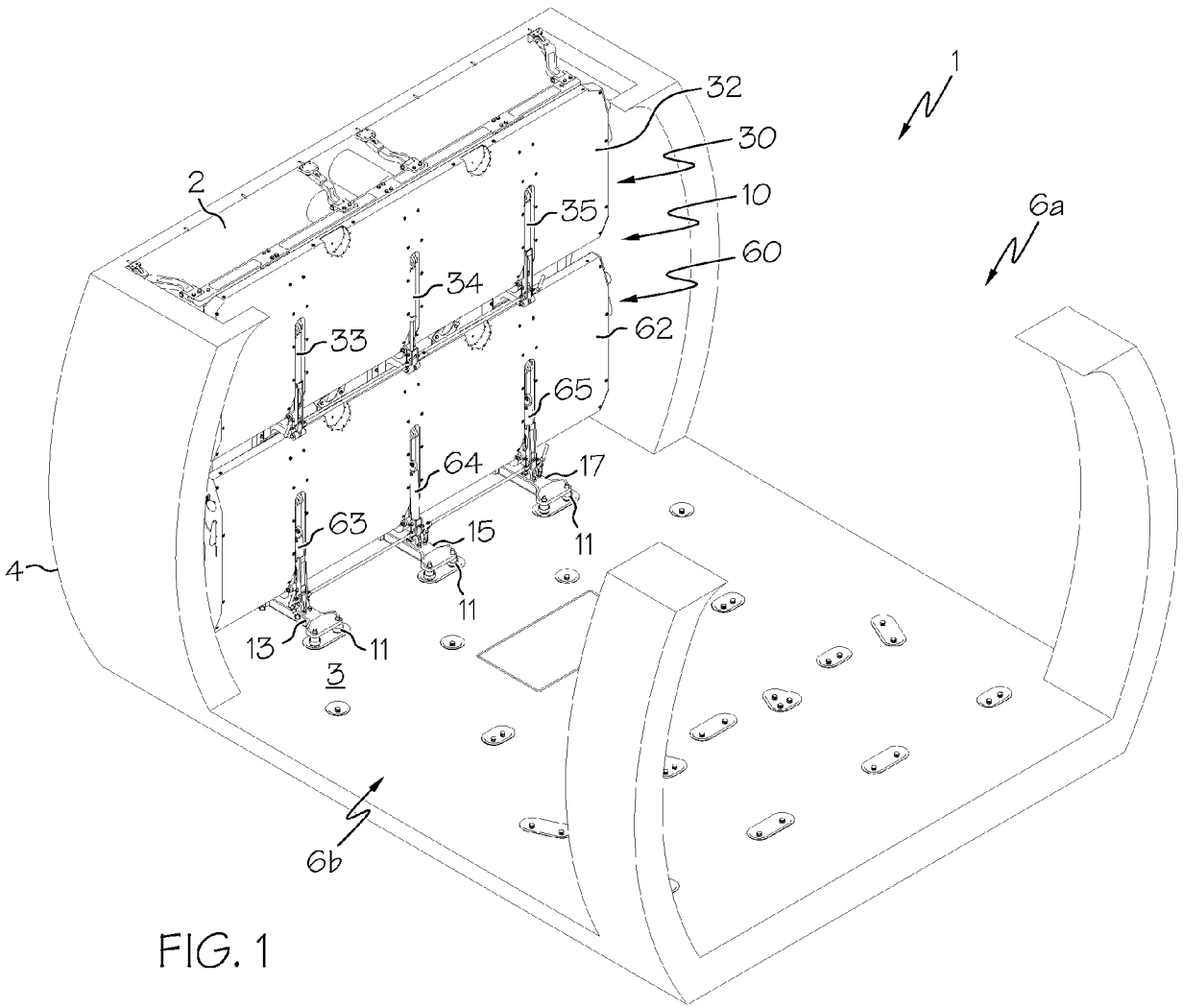
FIG. 1 is a perspective representation of an exemplary litter support system mounted within a utility vehicle according to one or more embodiments of the present invention.

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION OF THE INVENTION

The following text sets forth a broad description of numerous different embodiments of the present invention. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims. All publications and patents cited herein are incorporated herein by reference.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential to the present invention unless so stated. To the extent that any term recited in the claims at the end of this patent is referred to in this patent in a manner consistent with a single meaning, that is done for sake of clarity only so as to not confuse the reader, and it is not intended that such a claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 2:
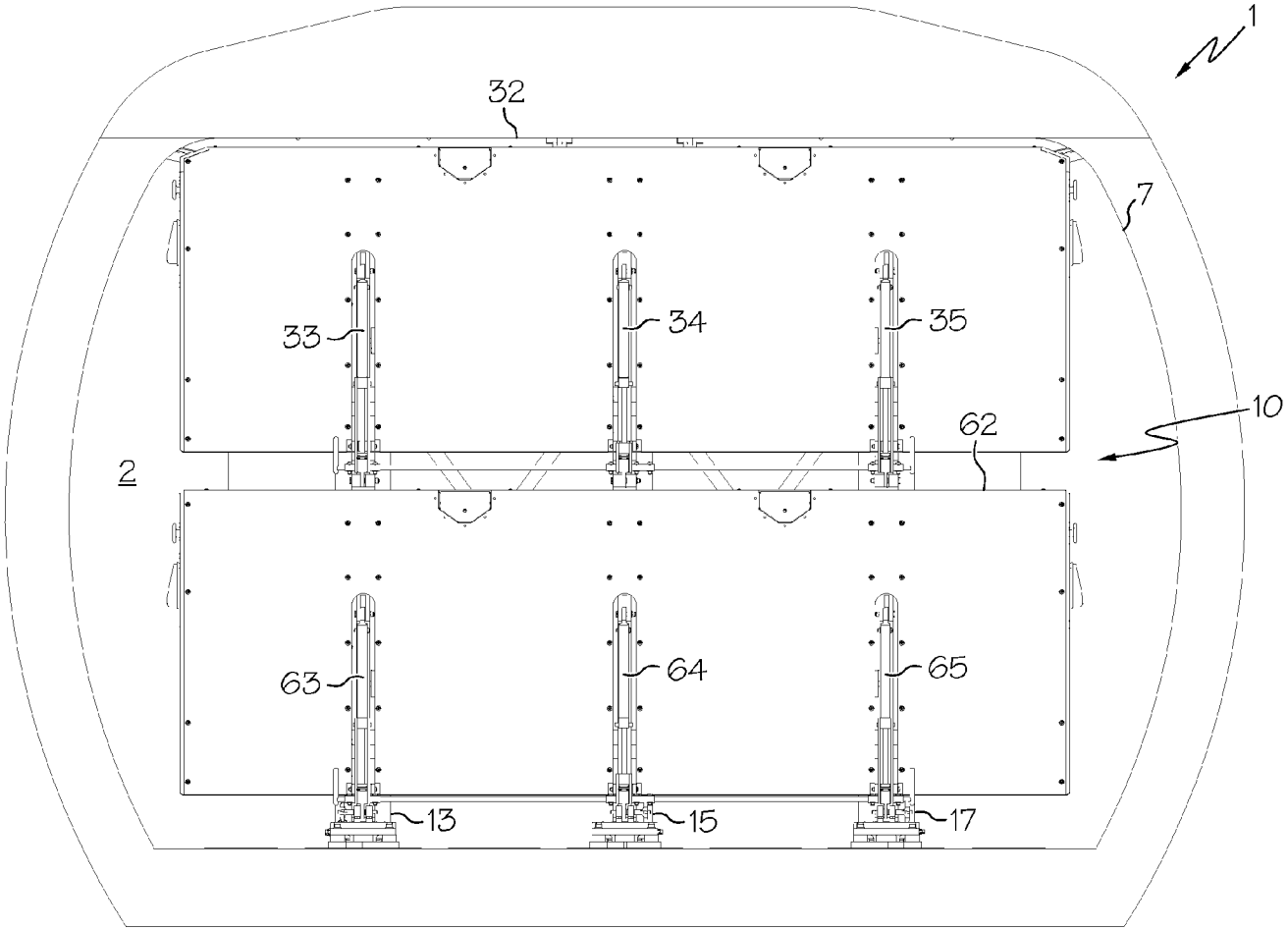
FIG. 2 is a front view of the litter support system according to FIG. 1.
Figure 3:
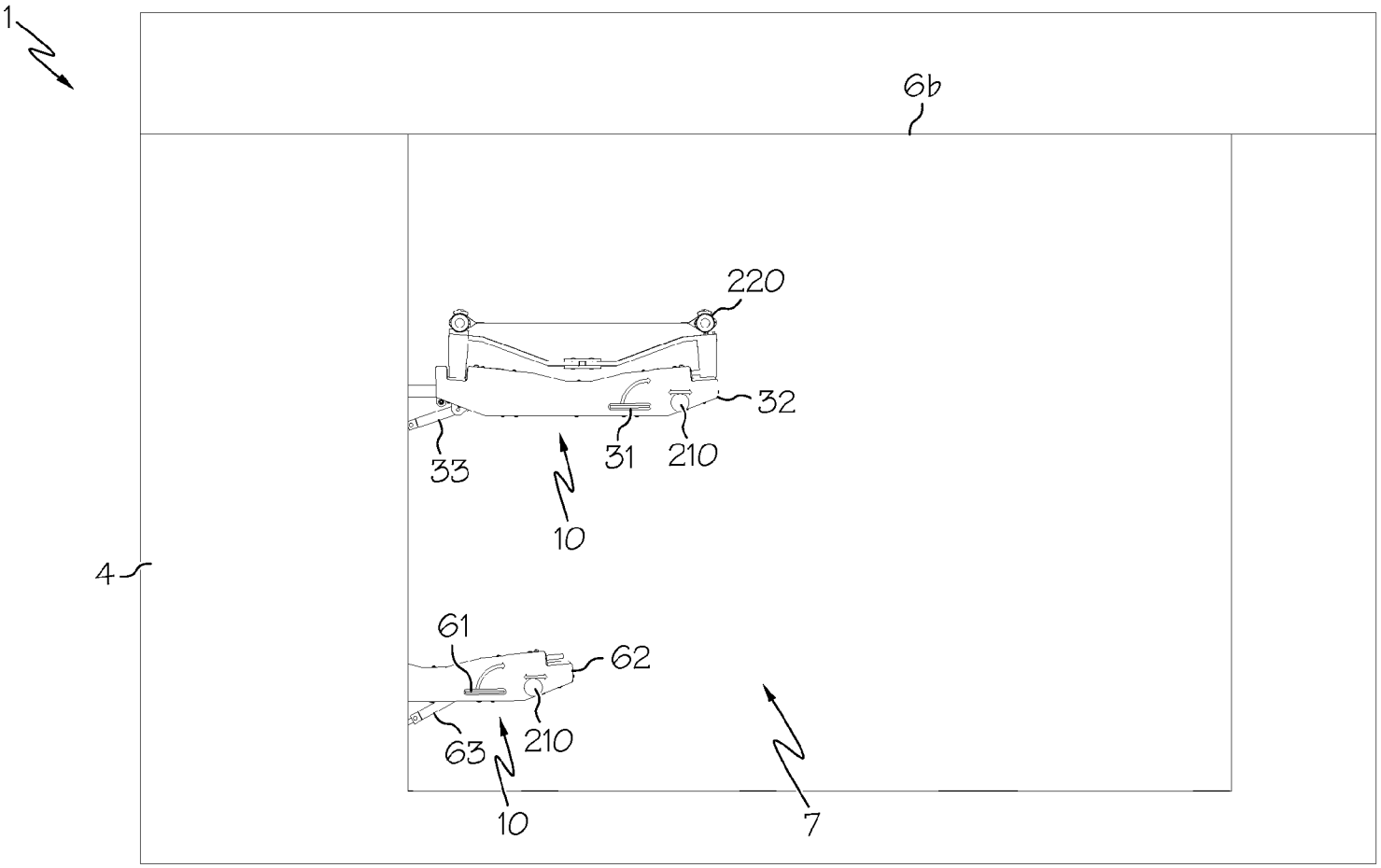
FIG. 3 is a side view of the litter support system according to FIG. 1.

Referring to FIGS. 1-3, an exemplary embodiment of a litter support system 10 connected and/or mounted within a passenger cabin 7 of a vehicle 1, more particularly, mounted to a back wall 2 and a floor 3 of the vehicle 1 as shown. Exemplary vehicles may include, but not be limited to, ambulances, airplanes, helicopters, or other emergency or support vehicles. In one exemplary embodiment, litter support system 10 is designed to be connected and/or mounted to a military helicopter such as, for example, a Blackhawk helicopter. For example, vehicle 1 shown in FIGS. 1-3 may comprise a helicopter having wall 2, floor 3, sidewalls 4, side entrance/exit doorways 6*a* and 6*b* disposed within sidewalls 4.

Litter support system 10 generally may include an upper litter support 30 and a lower litter support 60 movably mounted to a framework 5. Framework 5 may include a plurality of wall mounting devices 19 and floor mounting devices 11 to connect it to wall 2 and floor 3, respectively, of vehicle 1.

Referring to FIGS. 4-12 show the exemplary litter support system 10 isolated from vehicle 1, i.e., not in and mounted to the vehicle, for ease in describing and showing the exemplary litter support system of the present invention. Framework 5 may comprise one or more stanchions. The exemplary framework 5 shown comprises a first, substantially vertical stanchion 12, a second, substantially vertical stanchion 14, and a third, substantially vertical stanchion 16 interconnected with a cross brace 18 mounted at their respective upper ends. Also, each stanchion 12, 14, and 16 has a respective base frame 13, 15, 17 mounted at their respective lower ends opposite their respective upper ends as shown in FIGS. 4-7. In addition, first and second stanchions 12 and 14 may be interconnected to each other using a first upper brace 29, a first lower brace 22, and intersecting cross braces 25 and 26 positioned there between. Similarly, second and third stanchions 14 and 16 may be interconnected to each other using a second upper brace 20, a second lower brace 21, and intersecting cross braces 23 and 24 positioned there between.

In this exemplary embodiment, wall mounting devices 19 may be connected to cross brace 18 and floor mounting devices 11 may be connected to base frames 13, 15, and 17. The wall and floor mounting devices may comprise any variety of conventional devices as known to one of ordinary art that enable framework 5 to be connected to the respective wall and floor of emergency vehicle 1. For example, wall and floor mounting devices 19 and 11, respectively, may comprise mounting plates which may be connected and/or mounted to the respective wall and floor via conventional welds, bolts, nuts, screws, and/or other type connectors.

As set forth above, litter support system 10 may comprise upper litter support 30 and lower litter support 60 movably and rotatably mounted to framework 5. Referring specifically to FIGS. 6 and 9-12, an exemplary embodiment is shown of the litter support system. In the exemplary embodiment, upper litter support 30 may comprise an upper litter bed 32, three upper internal channels 50, 52, and 54 disposed within litter bed 32, three horizontal connecting arms 43, 46, and 49 slideably received within respective channels 50, 52, and 54, and three biasing cylinders 33, 34, and 35 rotatably connected to respective connecting arms 43, 46, and 49 at respective joints 70, 71, and 72. Still referring to FIGS. 6 and 9-12, lower litter support 60 may comprise a lower litter bed 62, three internal lower internal channels (not shown but similar to upper internal channels 50, 52, and 54) disposed within litter bed 62, three horizontal connecting arms (e.g., lower connecting arm 76 shown in FIG. 7) slideably received within the three respective channels, and three biasing cylinders 63, 64, and 65 rotatably connected to the three respective connecting arms at respective joints 73, 74, and 75.

Figure 7:
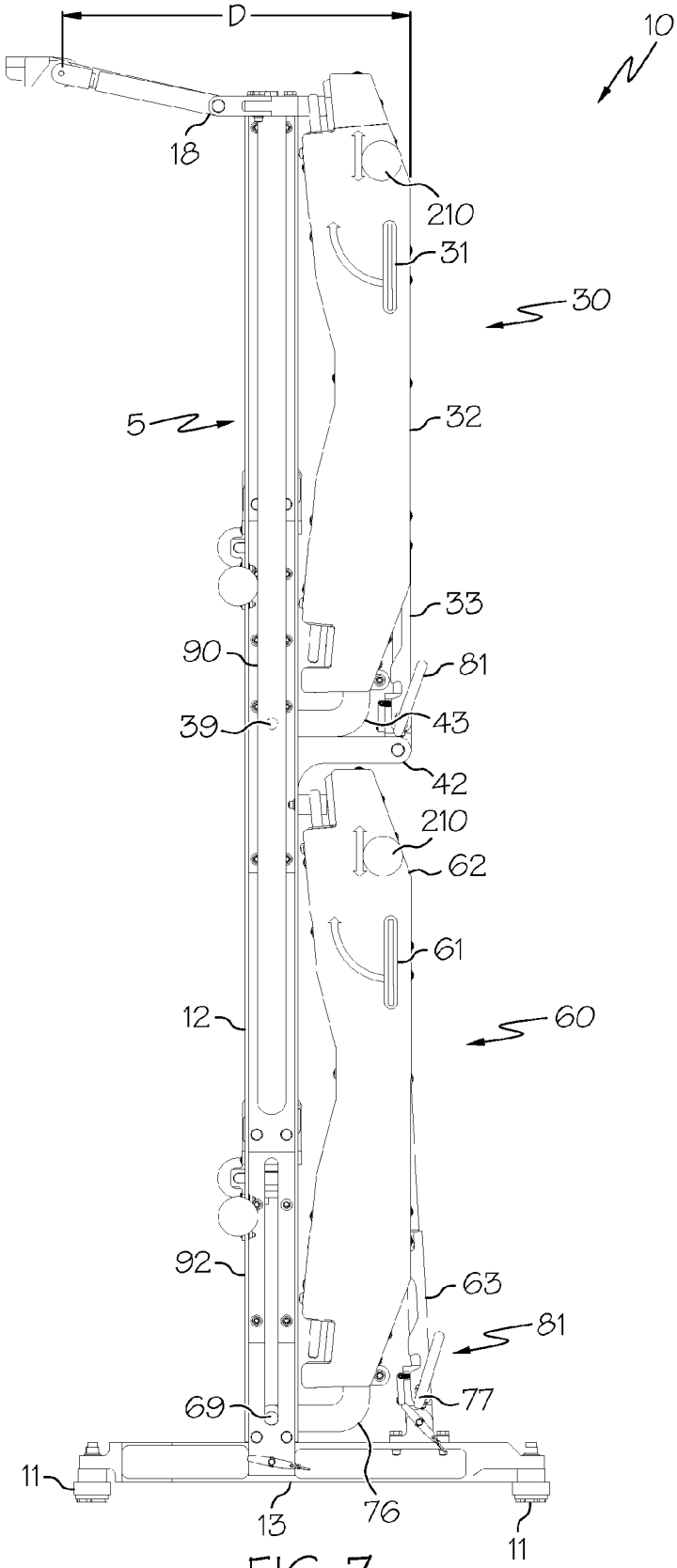
FIG. 7 is a side elevational view of the litter support system according to FIG. 4.
Figure 9:
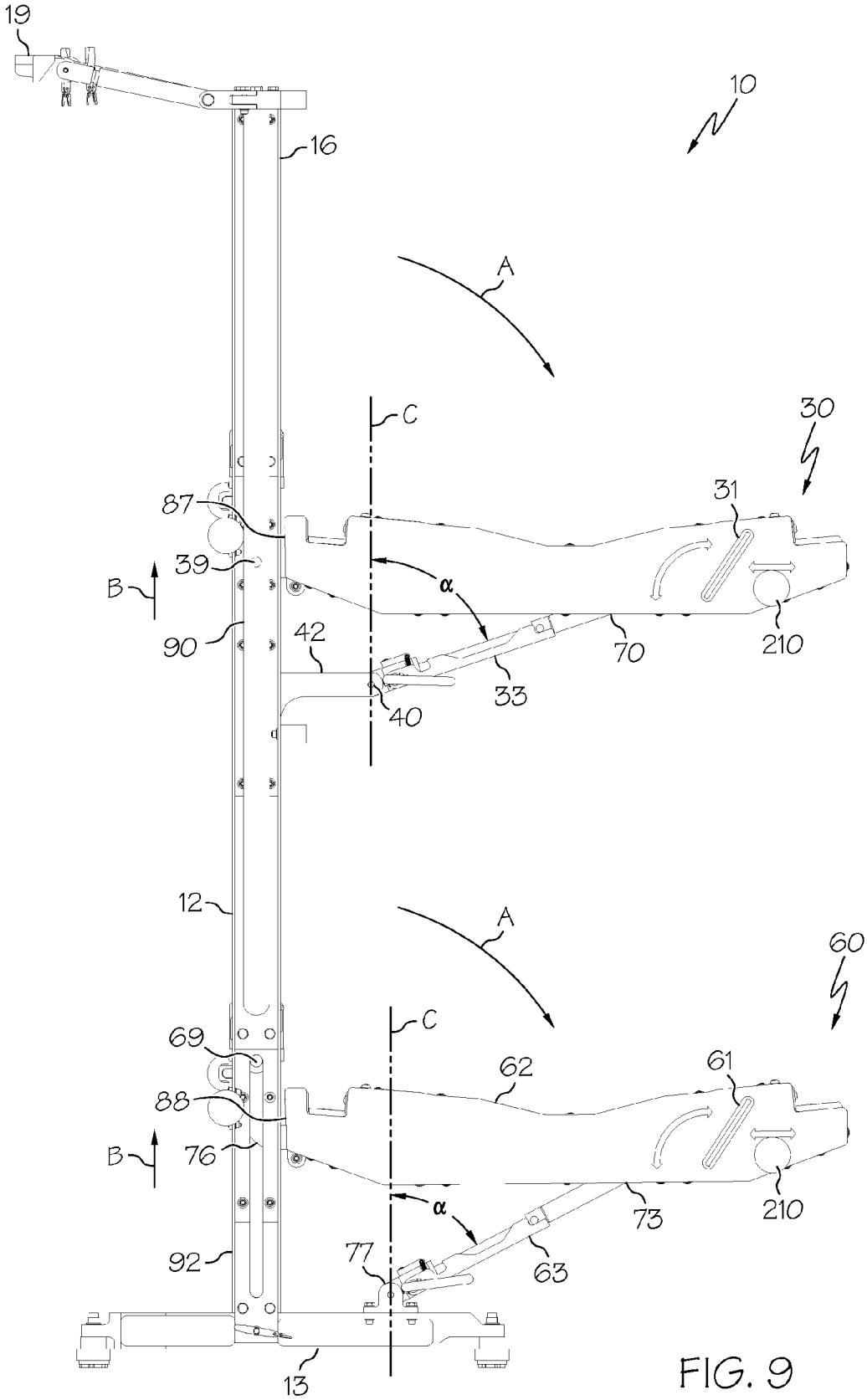
FIG. 9 is a side elevational view of the litter support system according to FIG. 8.
Figure 10:
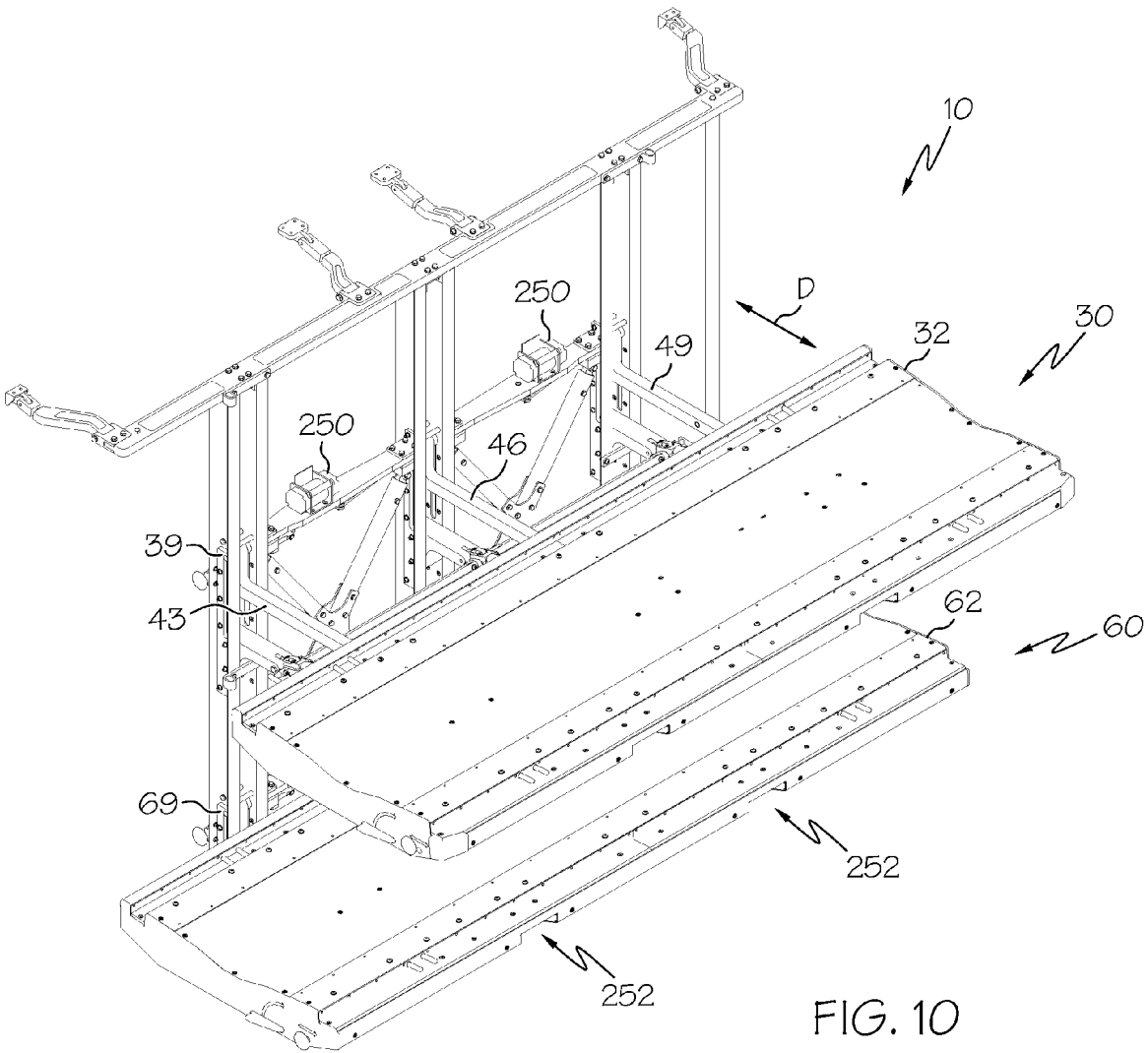
FIG. 10 is a front perspective view of the litter support system according to FIG. 4, wherein an upper support is in an extended support position and a lower support is in a contracted support position.
Figure 11:
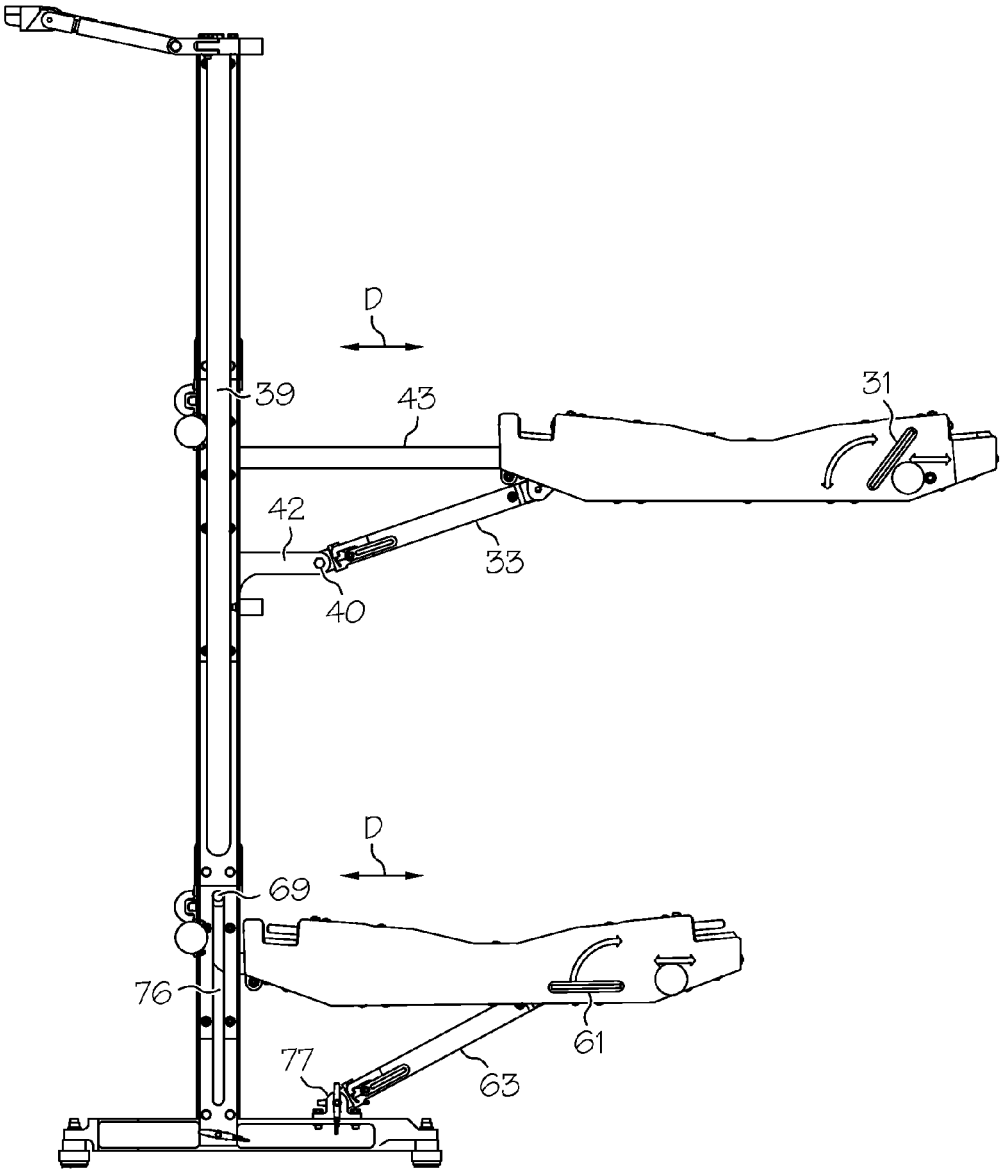
FIG. 11 is a side elevational view of the litter support system according to FIG. 10.

The horizontal connecting arms may be rotatably connected to the stanchions 12, 14, and 16, respectively, with respective sliding hinges. For example, upper connecting arm 43 may be connected to stanchion 12 with a sliding hinge 39, and lower connecting arm 76 may be connected to stanchion 12 with a sliding hinge 69 as shown in FIGS. 7, 9, and 11. It is understood that the other horizontal connecting arms (e.g., connecting arms 46 and 49 for upper bed 32 as well as the connecting arms for the lower bed 62 (not shown)) may be connected to respective stanchions 14 and 16 in a similar manner using similar sliding hinges. In addition, the biasing cylinders may be rotatably connected to either framework 5 or the base frames using a joint or hinge connection. For example, upper biasing cylinder 33 may be connected to an extension 42 of framework 5 using a rotatable joint 40. Similarly, lower biasing cylinder 63 may be connected to base frame 13 using a rotatable joint 77. It is understood that the other two upper biasing cylinders 34 and 35 may be rotatably connected to respective extensions 45 and 48 using respective rotatable joints 36 and 37. It is also understood that the other two lower biasing cylinders 64 and 65 may be rotatably connected to respective base frames 15 and 17 with respective rotatable joints 78 and 79.

Referring to FIG. 7, upper litter support 30 and lower litter support 60 are shown folded and collapsed in a position parallel with the stanchions, i.e., a store position. When in this position, biasing cylinders 33, 34, and 35 are in a substantially vertical position (i.e., substantially normal to extensions 42, 45, and 48 and parallel to the stanchions). In addition, the sliding hinges (e.g., hinges 39 and 69) of upper and lower supports 30 and 60 are positioned in a lower portion of a slot within the respective stanchions (e.g., respective slots 90 and 92 within stanchion 12). The present invention enables upper and lower supports 30 and 60, when folded up into the store position, to be very tight against wall 2 of vehicle 1, and thus take up very little space within the vehicle 1. For example, when folded up into the store position, the outermost surface of upper and lower supports 30 and 60 do not exceed a distance (D) from the wall. In one exemplary embodiment, distance (D) may be less than or equal to 12 inches, more particularly less than or equal to 10 inches, even more particularly less than or equal to 8 inches, even more particularly less than or equal to 7 inches, even more particularly less than or equal to 5 inches. In one example, distance (D) from the wall is less than or equal to 6.5 inches.

As shown in FIG. 9, upper and lower litter supports 30 and 60 may be rotated in a substantially clock-wise direction (identified as A) into a substantially horizontal position, normal to the stanchions. In this orientation, the litter supports are in a litter first support position (i.e., a first support position). When the upper and lower supports move from the store position shown in FIG. 7 to the first support position shown in FIG. 9, respective biasing cylinders (upper cylinders 33, 34, and 35 and lower cylinders 63, 64, and 65) move from their substantially vertical store positions to a position at an angle $\alpha$ from a vertical axis C and sliding hinges (e.g., hinges 39 and 69) of upper and lower supports 30 and 60 move in an upward direction within respective slots 90 and 92 of stanchion 12, as indicated by arrow B in FIG. 9. In one exemplary embodiment, angle $\alpha$ may range from about 0 degrees to about 90 degrees, more particularly from about 10 degrees to about 90 degrees, even more particularly from about 20 degrees to about 75. In another exemplary embodiment, angle $\alpha$ may range from about 40 degrees to about 70 degrees, particularly about 60 degrees.

Figure 12:
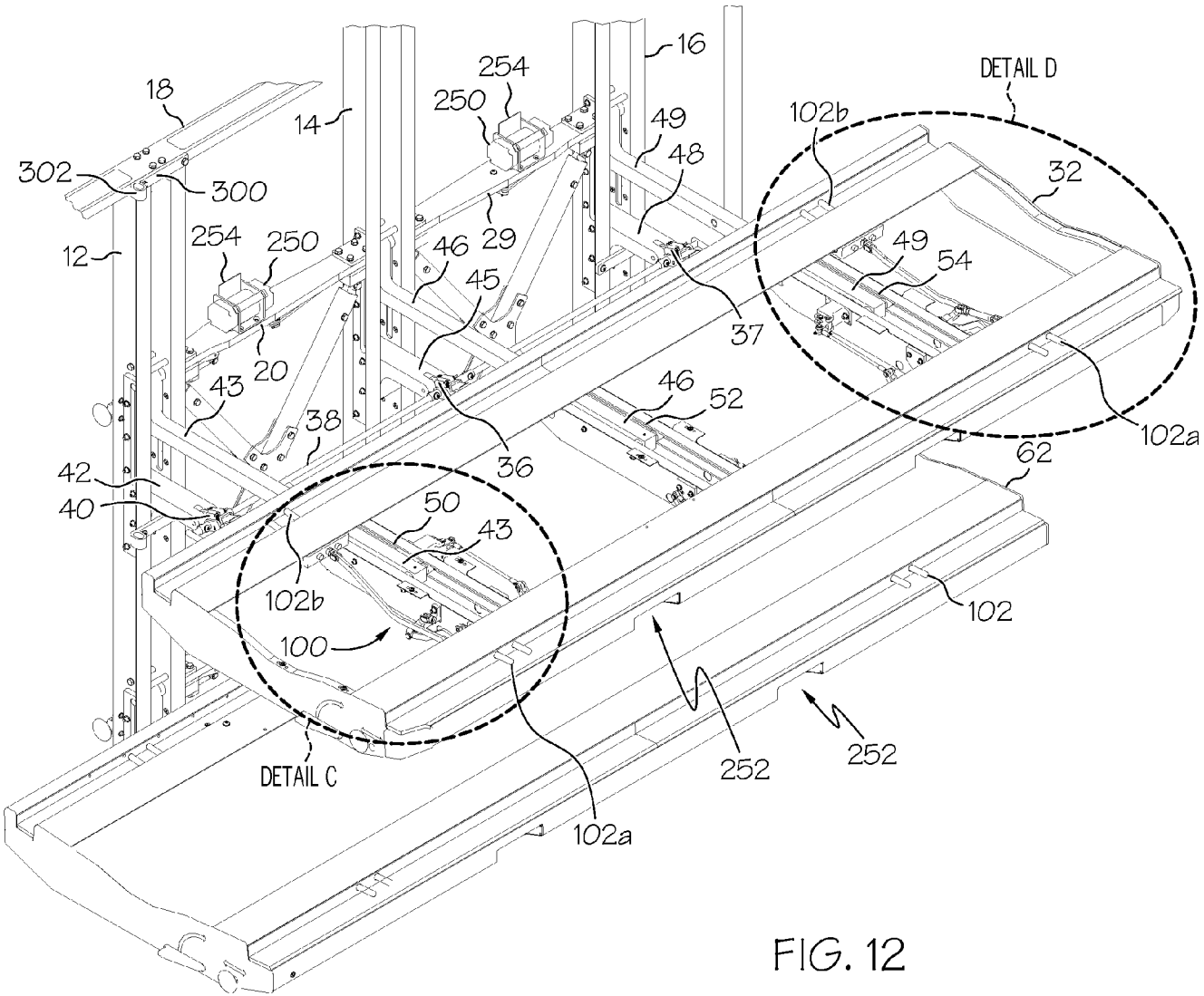
FIG. 12 is a front perspective view of the litter support system according to FIG. 11 with an upper surface of the upper support removed.

Referring to FIG. 9, upper litter bed 32 and lower litter bed 62 are in the first support position, wherein the inner sides 87 and 88, respectively, are in close proximity with the stanchions 12, 14, and 16. When in the first support position, the upper and lower beds 32 and 62 may each hold a respective litter 220 having a patient thereon during transport. (See also FIGS. 20 and 21). When unloading and/or loading the litters (with or without patients on the litters), upper and lower litter beds 32 and 62 may slide substantially horizontally and outwardly from the stanchions to a second support position or back inwardly as indicated by arrow D in FIGS. 10, 11, and 12. In this second support position exemplary embodiment, the entire bed and litter slides or moves outwardly from the first support position to the second support position along a substantially horizontal plane such that the respective inner sides of the beds are substantially further away from the stanchions 12, 14, and 16, i.e., in a second position different from the first. More particularly, FIG. 12 shows that the three respective channels 50, 52, and 54 have slid along and relative to the three upper horizontal connecting arms 43, 46, and 49 in a telescopic manner such that the upper litter bed 32 is substantially cantilevered from the three horizontal connecting arms 43, 46, and 49. It is understood that the three lower internal channels may be slid along and relative to their respective lower horizontal connecting arms in a telescopic manner such that lower bed 62 may be in a substantially cantilevered orientation from the three lower horizontal connecting arms when in the second support position.

In one exemplary embodiment, the litter support system 10 of the present invention may be configured such that when the upper and/or lower litter supports 30 and 60 are extended outwardly from the stanchions into this second support position, the upper and/or lower litter beds are positioned at the doorway of the vehicle such as a Blackhawk helicopter. Such positioning permits personnel to stand outside the vehicle at the doorway and load and unload litters (with or without patients) onto and from the upper and lower beds without having to climb inside the vehicle in an extremely simple and efficient manner. Once the litter (with or without a patient) is loaded onto the bed in the second support position (e.g., upper bed 32 shown in FIGS. 10 and 11), the bed may be slid back toward the stanchions into the first support position for transport within the vehicle. (See FIG. 21).

Additionally, the exemplary embodiment shown may include one or more bed locking mechanisms to lock or assist in locking the upper bed 32 and the lower bed 62 into the first support position. For example, the locking mechanism for the beds may comprise one or more pull knobs 210 disposed at one or more ends of the beds and connected to a linkage (not shown) running along the bed, which in turn, is connected to an insert (not shown) that may insert into respective holes within an internal channel and a corresponding horizontal connecting arm, locking them into a fixed position. When the insert is inserted within the respective holes of the internal channel and connecting arm, the insert prevents the horizontal connecting arm from slide within and relative to the internal channel, thus preventing the bed from slide and/or telescoping outwardly into the second support position. When the pull knob 210 is pulled outwardly the insert slides out of the hole of the connecting arm, permitting it to slide within the internal channel and thus allowing the bed to move or telescope outwardly to the second support position. When the pull knob is pushed back in by personnel, the inserts are caused to move into the respective holes of the internal channel and connecting arm, locking them into the fixed position. Such a bed locking mechanism prevents the beds from unintentionally slide or telescoping out into the second support position (i.e., the load/unload position). It is understood that the pull knob, linkage, and insert may be biased (e.g., spring biased) in the locked position such that when the pull knob is released the inserts are pushed inwardly by a spring. Thus, when the bed is slid back into the first support position and the holes of the internal channel and connecting arm are aligned with the insert, the spring forces the insert back into the holes of the internal channel and connecting arm, locking them into the fixed position.

Figure 13:
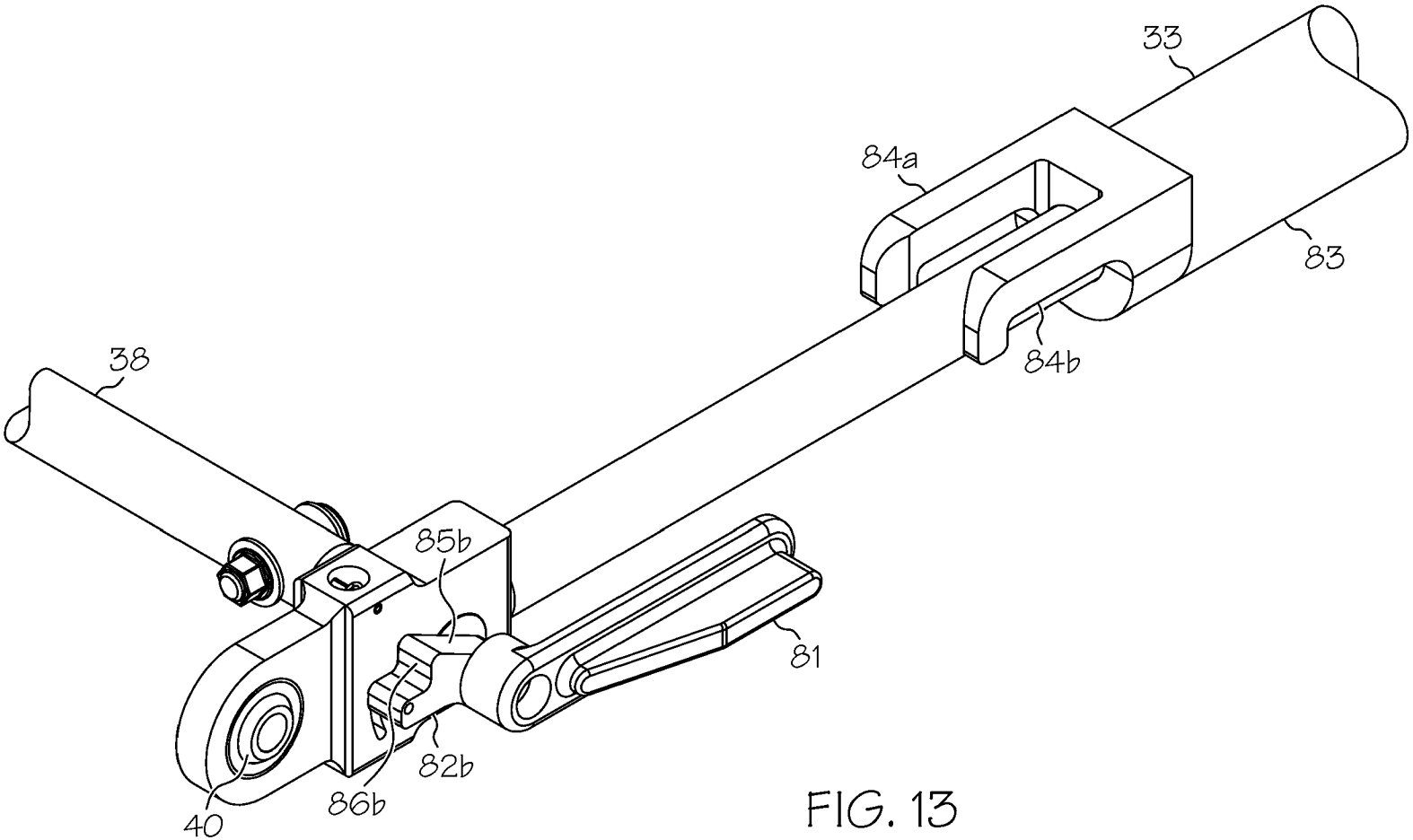
FIG. 13 is a left side perspective view of an exemplary biasing cylinder in of the litter support system in an unlocked and extended position according to one or more embodiments herein.
Figure 14:
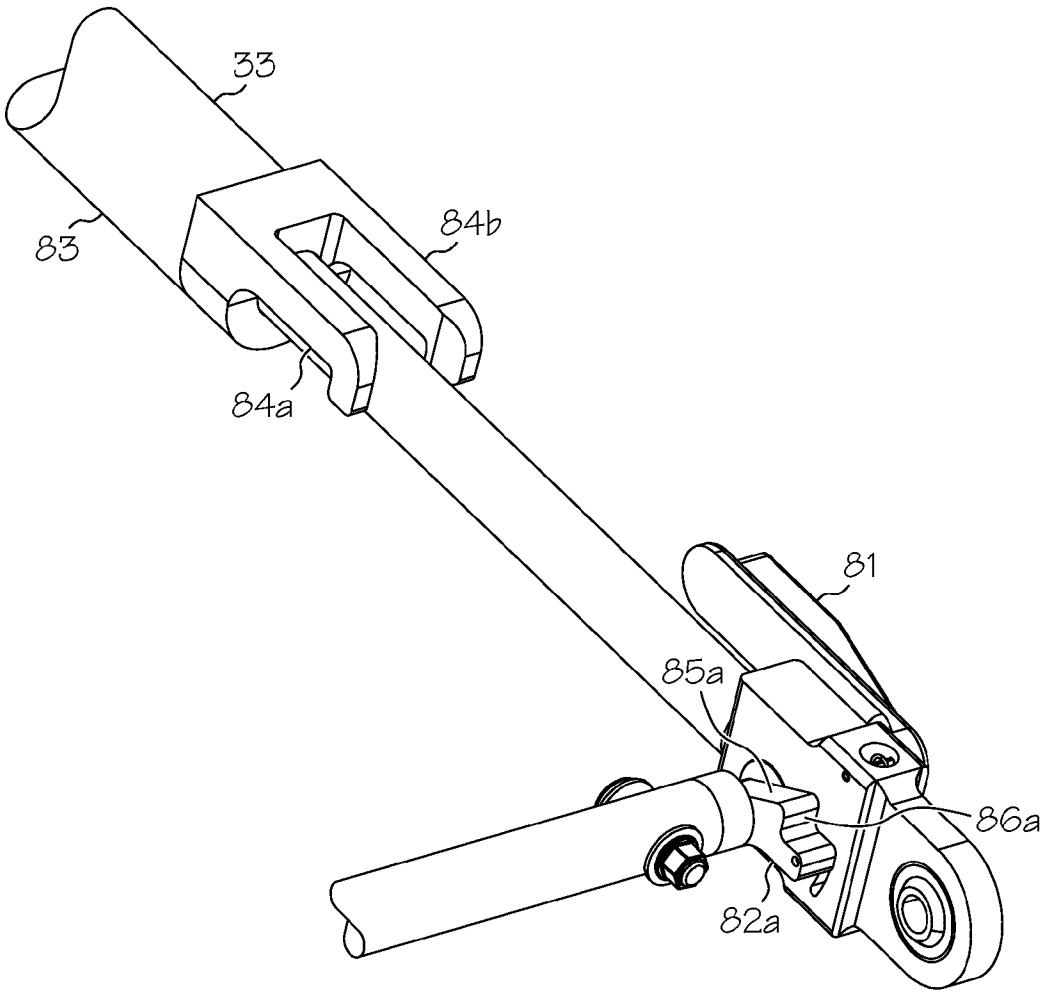
FIG. 14 is a right side perspective view of the biasing cylinder taken according to FIG. 13.
Figure 15:
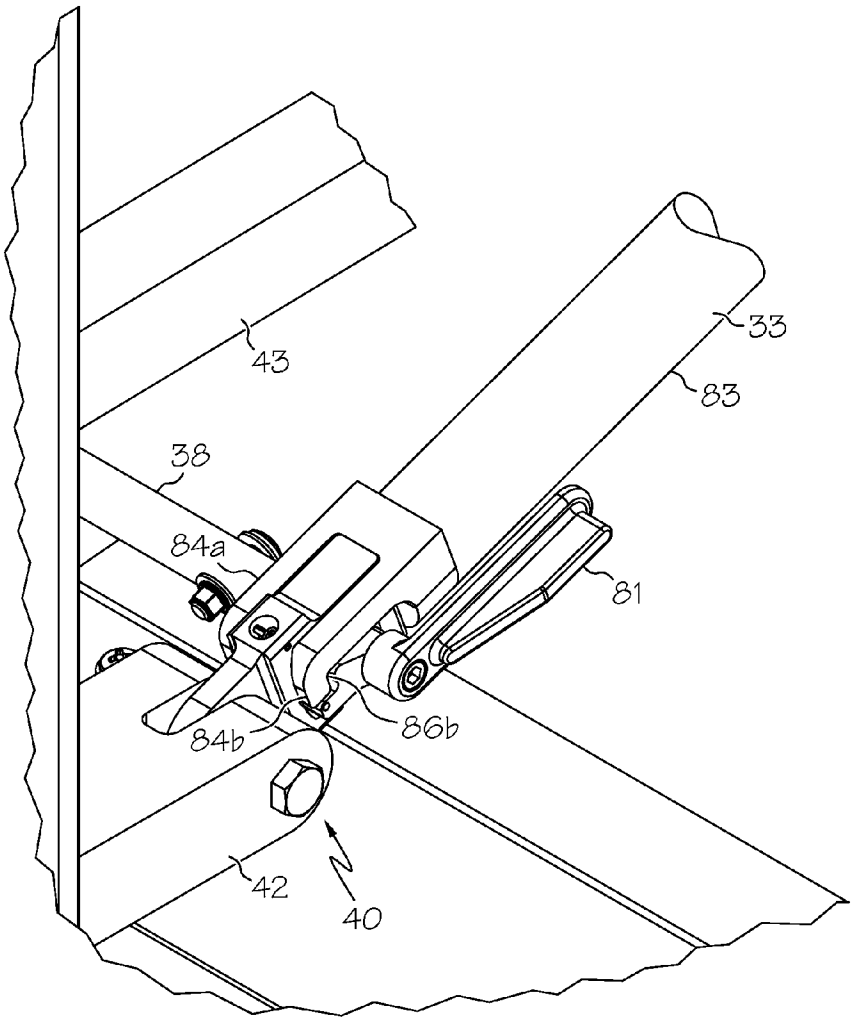
FIG. 15 is a left side perspective view of an exemplary biasing cylinder of the litter support system in a locked and contracted position according to one or more embodiments herein.

In addition, each biasing cylinder may include a cylinder locking mechanism in order to lock the cylinders into a contracted position when the respective litter beds 32 and 62 are in the first and/or second support positions. This ability to lock the biasing cylinders prevent (i.e., locks) the beds from inadvertently collapsing and folding upwards toward the stanchions into the store position (i.e., rotating counter clockwise) while in the support positions. For example, as shown in FIGS. 13, 14, and 15, biasing cylinder 33 may include two fingers 84*a* and 84*b* that are connected to the outer cylinder 83 of biasing cylinder 33 and engage respective locking devices 82*a* and 82*b*. The locking devices 82*a* and 82*b* may include respective cam surfaces 85*a* and 85*b* and respective locking surfaces 86*a* and 86*b*. Specifically, when the beds are in the litter support positions (either first support or second support positions), the two fingers 84*a* and 84*b* are engaged and locked against respective locking surfaces 86*a* and 86*b*, preventing the biasing cylinders from telescope outwardly and thus the beds from rotating into the store position.

Figure 6:
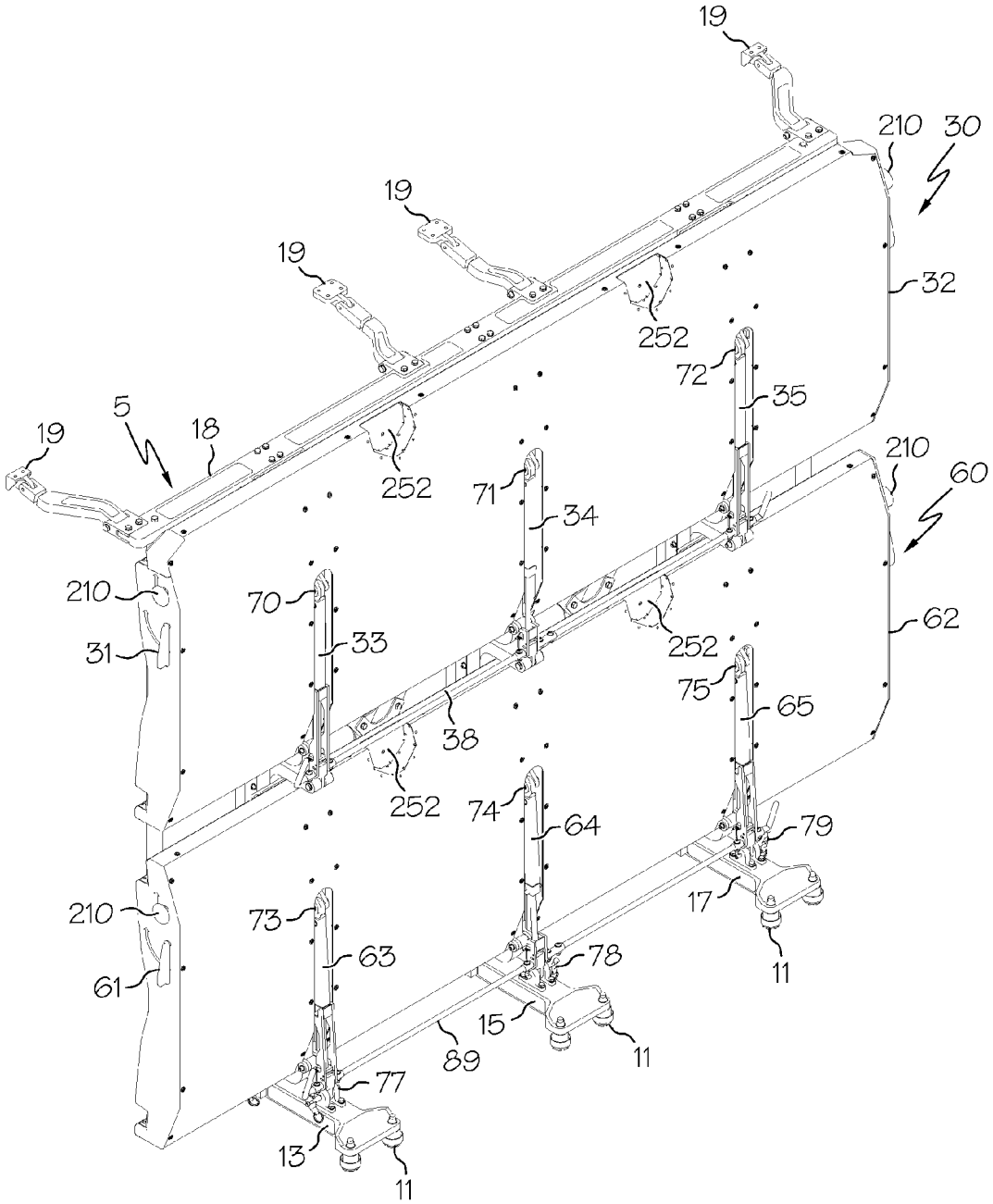
FIG. 6 is a front perspective view of the litter support system according to FIG. 4.

The locking mechanism may include a handle 81 connected to the two locking devices 82*a* and 82*b*, which can be moved to cause the locking surfaces 86*a* and 86*b* to disengage the fingers 84*a* and 84*b* and thus unlock the biasing cylinders (e.g., biasing cylinder 33). Once the biasing cylinder(s) is unlocked, the beds may be rotated counter clockwise into the store position as shown in FIG. 6. The inherent spring bias (or gas pressure) of the cylinders provides sufficient resistance in order to prevent the beds from unintentionally rotating back into the support position. In other words, the biasing cylinder are designed such that it requires an additional force besides the weight of the beds to overcome the cylinder force holding the beds in the store position.

When the upper and/or lower beds 32 and 62 are rotated in a clockwise direction from the store position into the first support position, the biasing cylinders (e.g., upper biasing cylinder 33) contract such that the fingers 84*a* and 84*b* engage the respective cam surfaces 85*a* and 85*b* and lockingly engage the respective locking surfaces 86*a* and 86*b*. As such, the biasing cylinders are locked in the contracted position. In this locked position, the beds (e.g., upper bed) are also locked in the first support position. It is understood that the other biasing cylinders for the upper bed may be connected together via rod 38 and thus all simultaneously operated by handle 81. Similarly, all three biasing cylinders of the lower bed 62 may be connected together via a single rod 89 and thus operated simultaneously by one or more handles 81. Handle 81 may be positioned on one or both ends of the litter support system such that the handle(s) may be reached by personnel standing outside of the vehicle. FIG. 15 shows joint 40 of the biasing cylinder 33 connected to extension 42 of the framework, providing a rotatable connection between the biasing cylinder and the framework. It is understood that all the biasing cylinders may include a similar connection to the framework as shown in FIG. 15.

It is understood that the present invention may include a second pull knob 210 positioned on the opposite end of the bed from the first pull knob 210 as shown in FIG. 6. This second pull knob may also be connected to a linkage (not shown) that connects it to an insert, wherein the insert slides in and out of respective holes of an internal channel and corresponding connecting arm on a side opposite the first insert. Such a second bed locking mechanism may be spring biased similar to the first locking mechanism set forth above.

Figure 16:
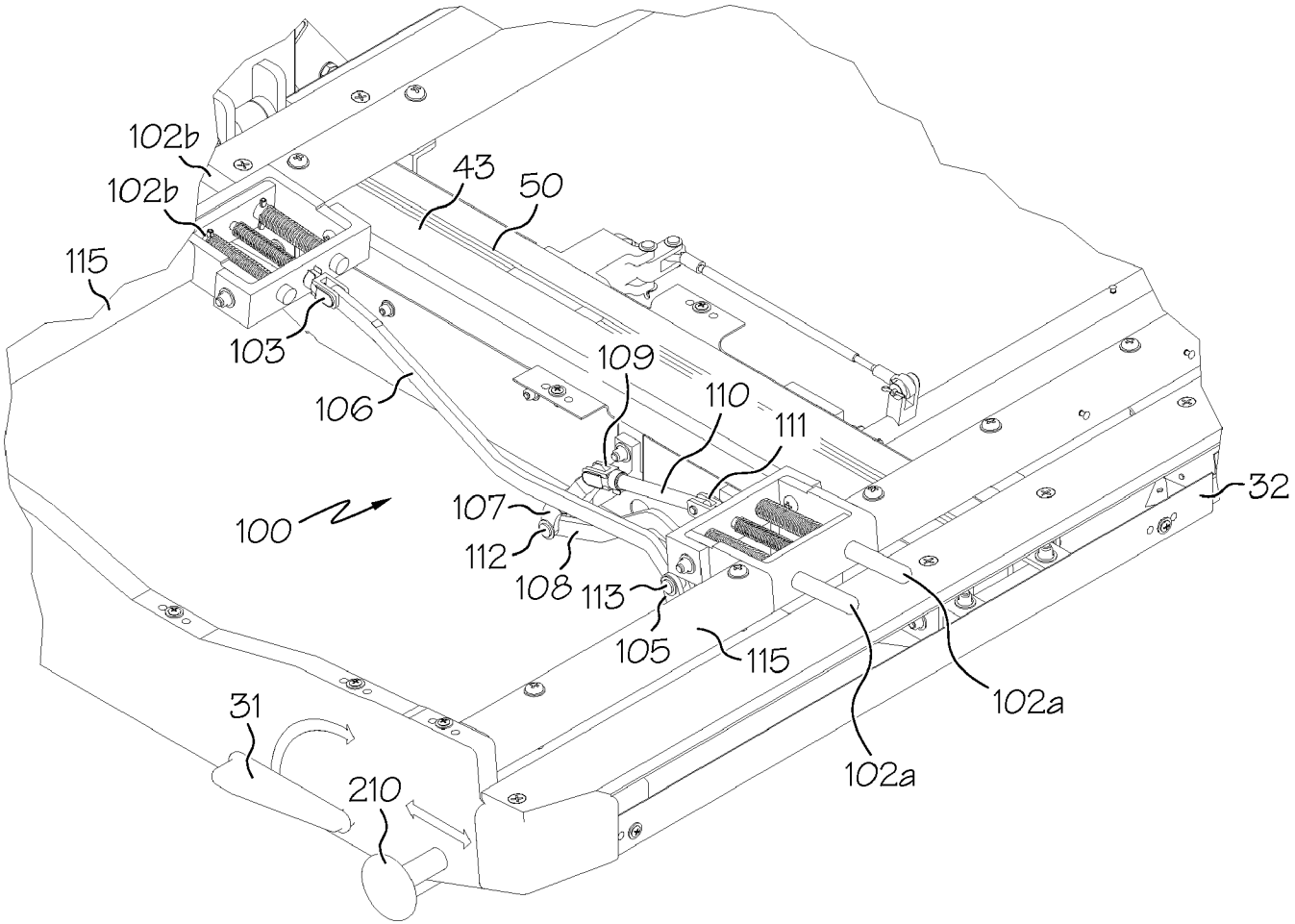
FIG. 16 is a perspective view taken at Detail C of FIG. 12 of an exemplary first litter locking mechanism.
Figure 19:
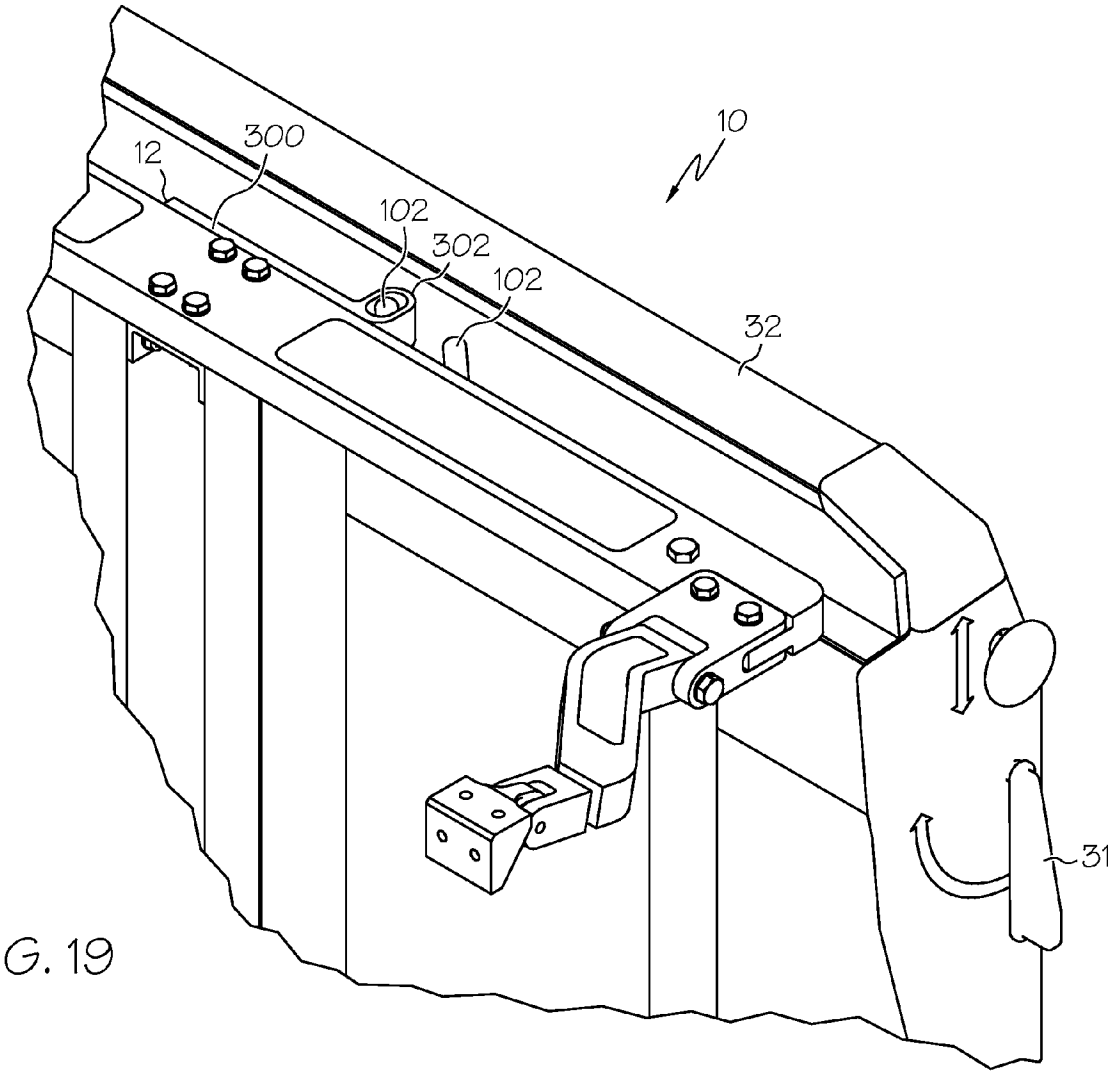
FIG. 19 is a perspective view of an exemplary upper litter bed in the store position according to the present invention.
Figure 20:
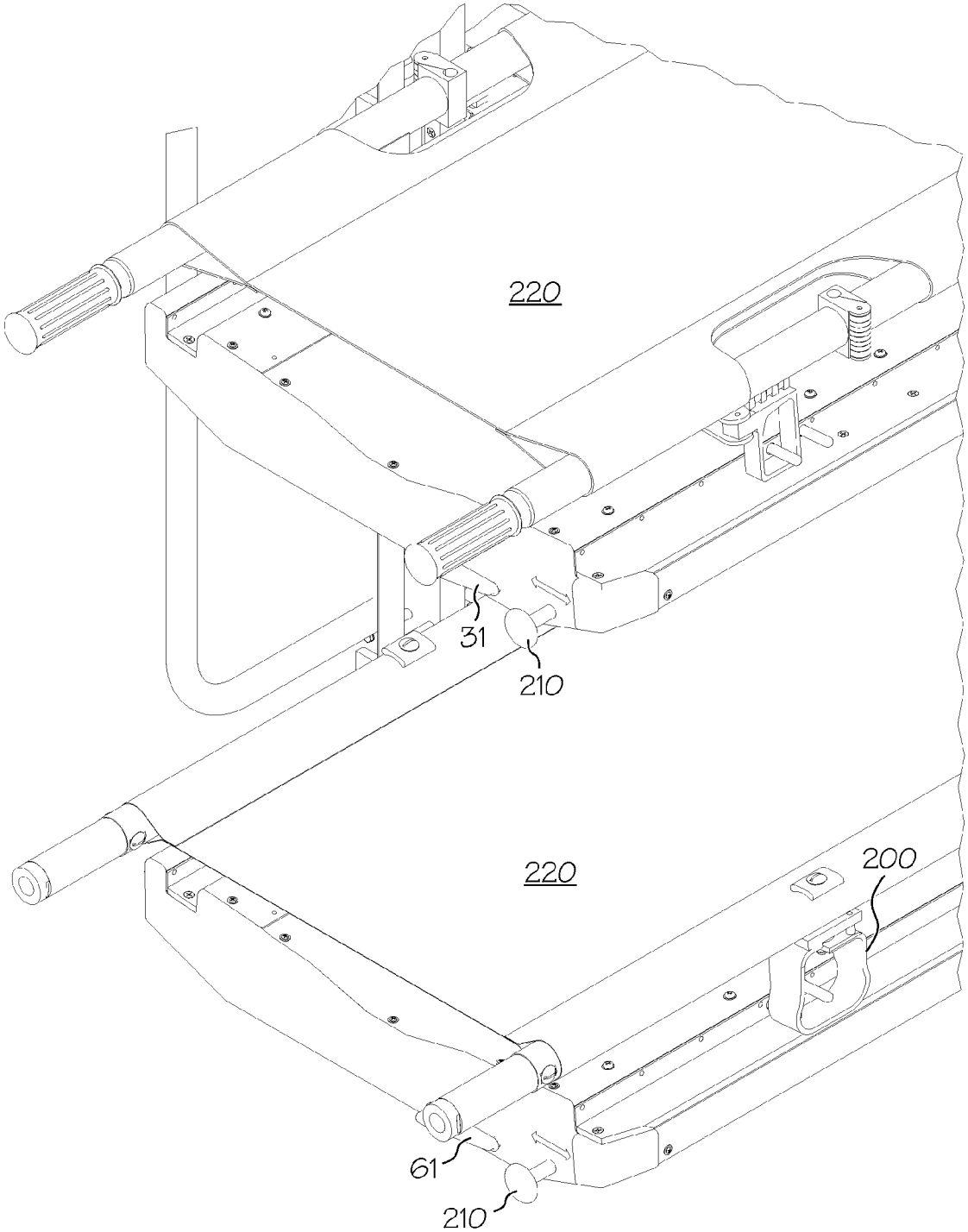
FIG. 20 is a front perspective view of an exemplary litter support system with two litters loaded onto the system according to one or more embodiments of the present invention.
Figure 21:
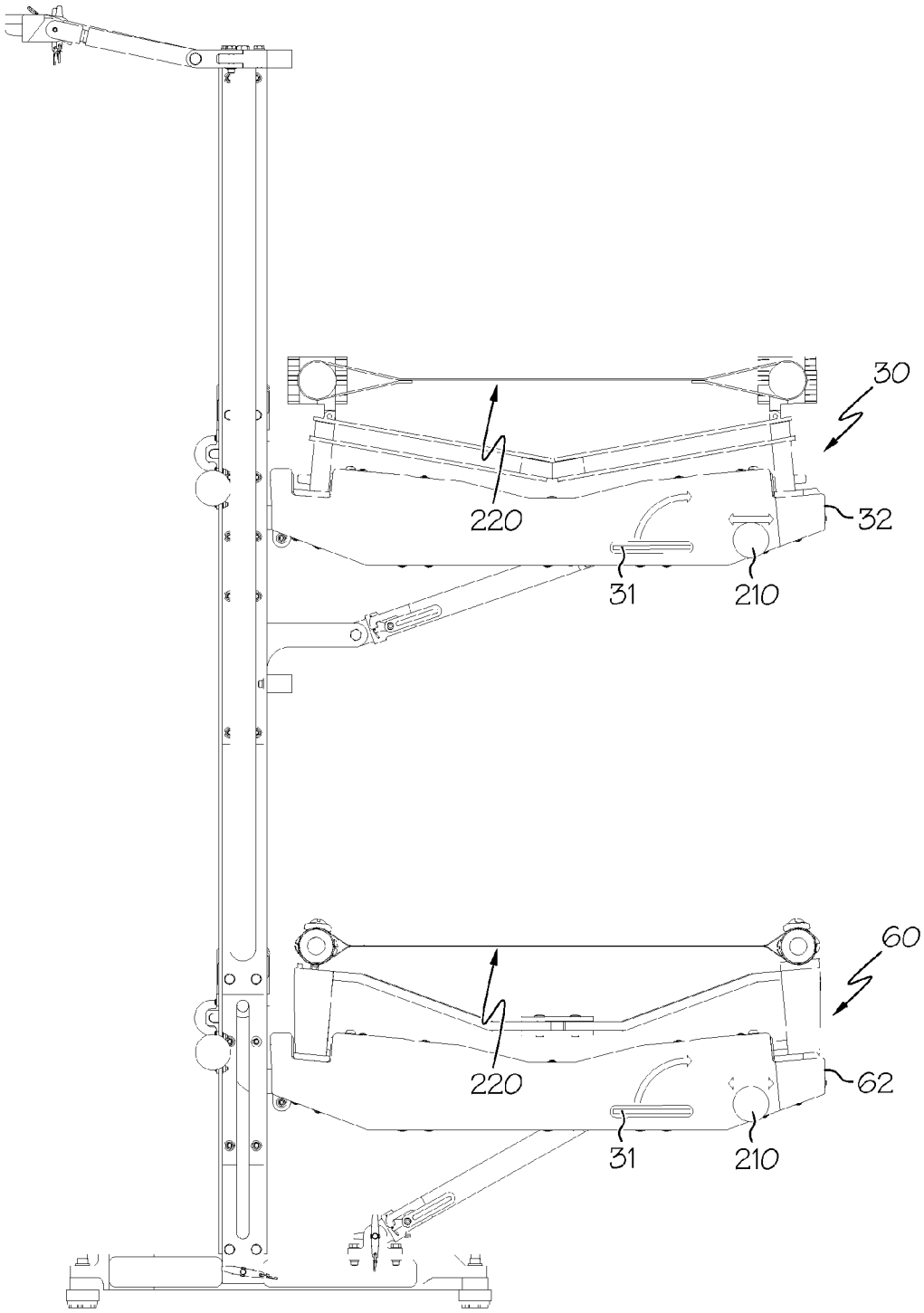
FIG. 21 is a side elevational view of the exemplary litter support system according to FIG. 20.

In one exemplary embodiment, the litter support system of the present invention may include a first litter securing device 100 positioned at one end of a bed (e.g., upper bed 32 and/or lower bed 62) and a second litter securing device 140 positioned at an opposite end of the bed as shown in FIG. 12. The first and second securing devices 100 and 140 may secure or lock the litter 220 to the bed (e.g., upper bed 32 and lower bed 62) as shown in FIGS. 20 and 21. For example, referring to FIGS. 12, 16-21, litter securing device 100 may comprise one or more pins 102 that insert into and/or between each support leg 200 of a litter. As shown in FIGS. 12 and 16, the pins 102 may comprise first pins 102*a* and second pins 102*b*, each positioned on each side of the bed (e.g., upper bed 32). First and second pins 102*a* and 102*b*, each may comprise one or more pins themselves.

Also, first and second pins 102*a* and 102*b* may be connected to each other through a series of interconnected linkages and to one or more levers (e.g., upper bed lever 31 and lower bed lever 61) positioned on one or both ends of the bed (e.g., upper bed 32 and lower bed 62) as shown in FIG. 12. In this exemplary embodiment, first pins 102*a* may be connected to a first linkage 110 via a rotatable joint 111. First linkage 110 may be connected to a second linkage 107 via another rotatable joint 109. Second linkage 107 may be connected to a third linkage 108 via another rotatable joint 112. Third linkage 108 may be connected to a fourth linkage 106 via a rotatable joint 105. Also, fourth linkage 106 may be connected to second pins 102*b* positioned on a side of the bed opposite the first pins 102*a* via a rotatable joint 103. Rotatable joint 105 also connects third and fourth linkages 108 and 106 to connecting rod 104. Connecting rod 104 runs the length of the bed (e.g., upper bed 32), connecting a first lever 31 and a second lever (not shown) positioned on opposite ends of the bed such that they may be accessible by personnel standing outside the vehicle at a doorway.

Figure 17:
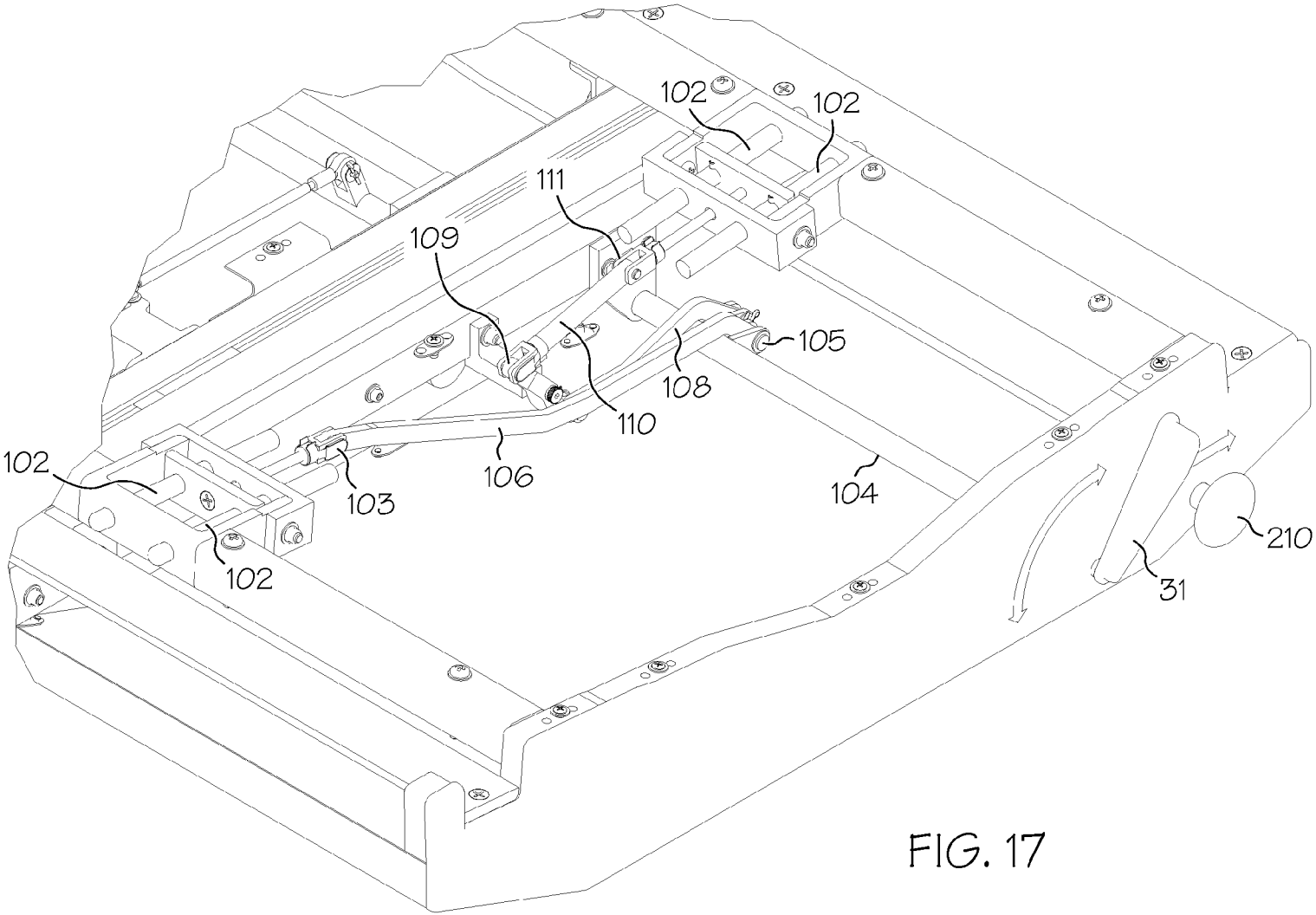
FIG. 17 is another perspective view of the litter locking mechanism according to FIG. 16.
Figure 18:
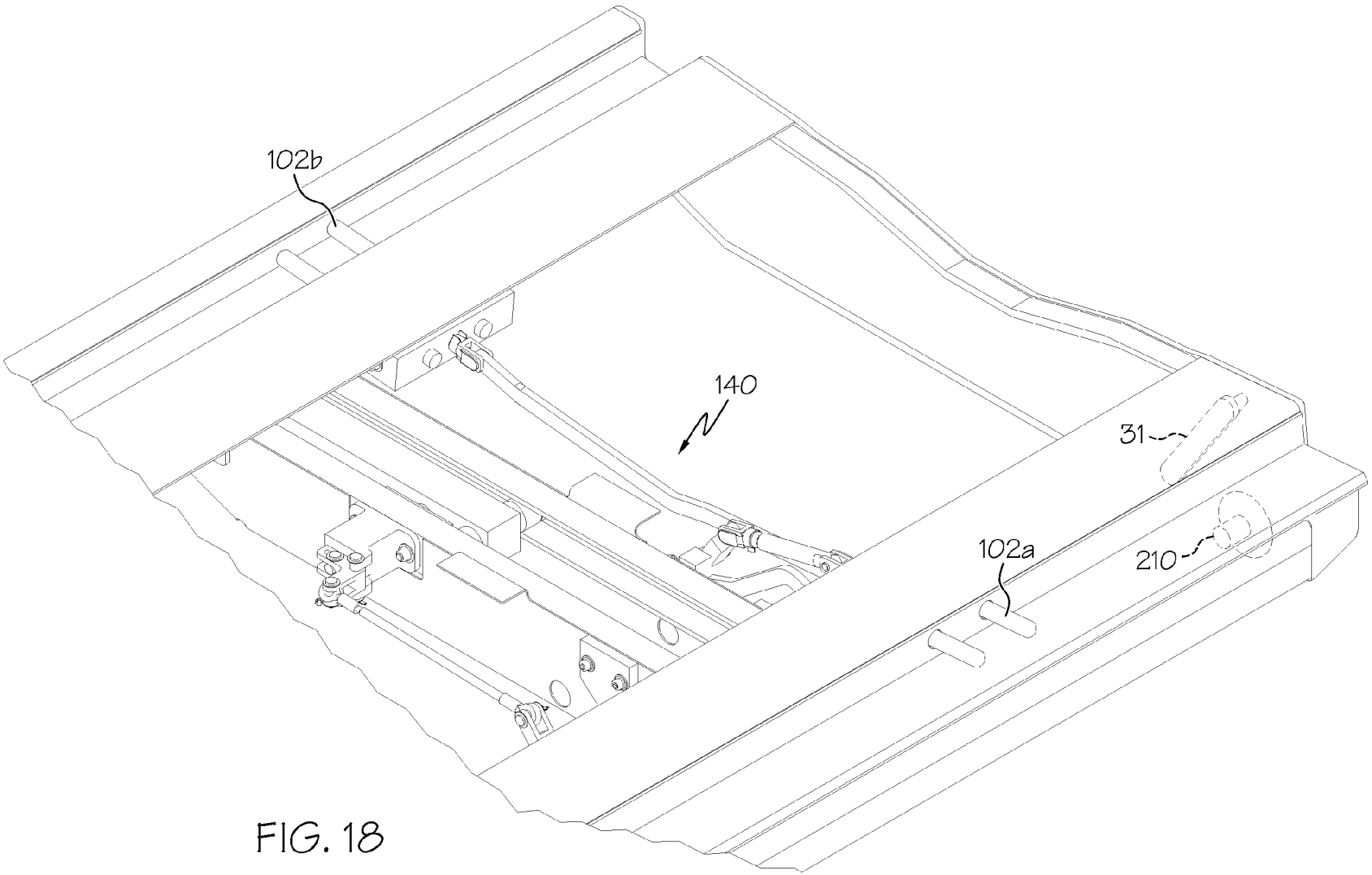
FIG. 18 is a perspective view taken at Detail D of FIG. 12 of an exemplary second litter locking mechanism.

If the first lever 31 (or second lever) is moved (e.g., rotated in a clockwise direction as shown in FIGS. 16-18, 20, and 21) to an unlock position, the lever rotates rod 104, which in turn causes the series of linkages described above to move the first and second pins 102*a* and 102*b* to slide inwardly into a recessed position as shown in FIGS. 17 and 18. In the recessed position (i.e., unlocked position), the pins do not protrude outwardly past a horizontal frame 115 that is disposed along the outer side edges of the bed, and thus do not insert into or between the litter support legs 200. This permits the litters to be removed from the litter beds (e.g., upper bed 32 and lower bed 62). When lever 31 (and/or the second lever) is moved (e.g., rotated in a counterclockwise direction to the locked position, the lever rotates rod 104 causing the series of linkages set forth above to move first and second pins 102*a* and 102*b* outwardly from the recessed position to an extended position from frame 115 as shown in FIGS. 16, 20, and 21. The pins may be spring loaded to default to the locked position, i.e., the extended position shown in FIG. 16.

Second litter securing device 140 may comprise one or more of the elements as described above herein for the first litter securing device 100 and operate the same as well. Moreover, either one or both beds may comprise such litter securing devices as set forth above herein. It is also understood that the present invention may not include such litter securing devices or other types of litter securing devices.

Additionally, the upper and lower litter beds 32 and 62 may comprise a bed fastening device 300 that connects, locks, and/or secures the bed (e.g., upper bed 32) to one or more of the stanchions (e.g., stanchion 12). As shown in FIG. 19, bed fastening device 300 comprises a loop 302 that the pin 102 may slide into when the beds (e.g., upper bed 32 and lower bed 62) are in the store position, thus locking the bed into the store position. For example, before the beds are rotated from the first support position into the store position, lever 31 may be rotated from the "Litter Locked" position into the "Litter Unlocked" position, thus causing the pins 102 to slide inwardly into the side of the beds. Once the beds are rotated into the store position, the lever 31 may be rotated from the "Litter Unlocked" position into the "Litter Locked" position, which causes the lever 31 to slide outwardly and insert into the loop 302. As such, the beds (e.g., upper bed 32) is locked or secured to the framework (e.g., stanchion 12) in the store position. When it is desired to rotate the bed out of the store position into the first support position, the lever 31 may be rotated from the "Litter Locked" position into the "Litter Unlocked" position, which will cause the pins to slide inwardly into the side of the beds and out of the loop 302. As such, the beds are unsecured and capable of moving from the store position.

Figure 4:
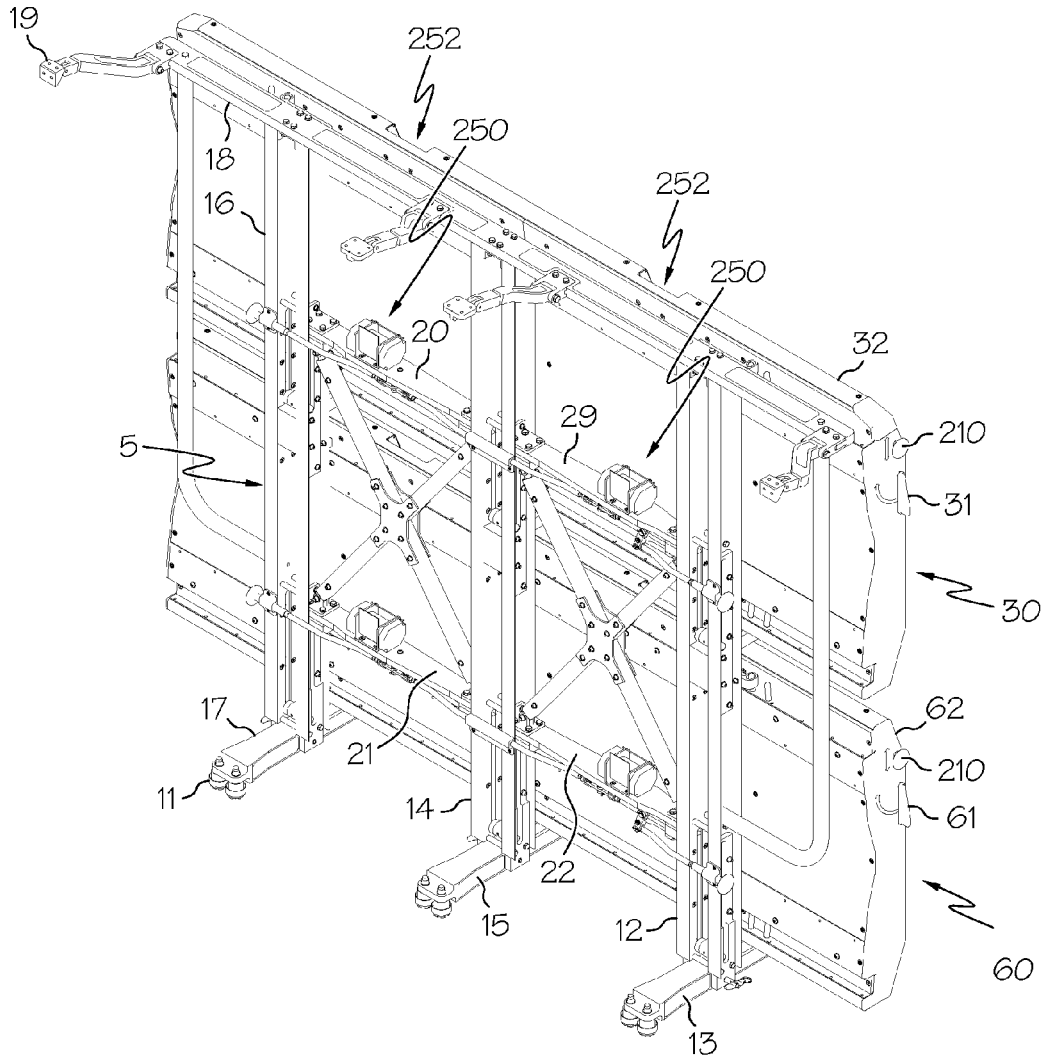
FIG. 4 is a back perspective view of an exemplary litter support system isolated from a utility vehicle according to one or more embodiments of the present invention.
Figure 5:
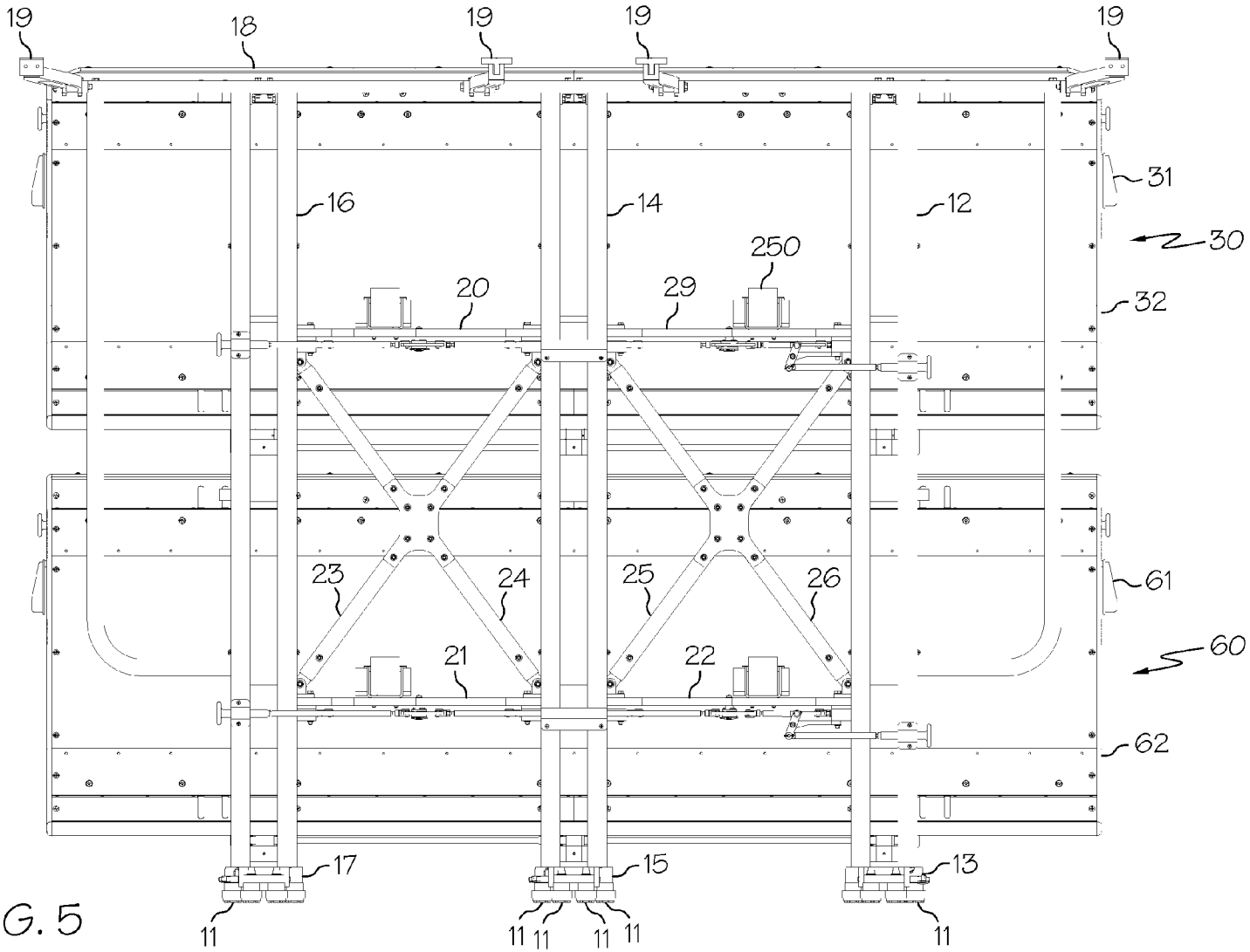
FIG. 5 is a back view of the litter support system according to FIG. 4.
Figure 8:
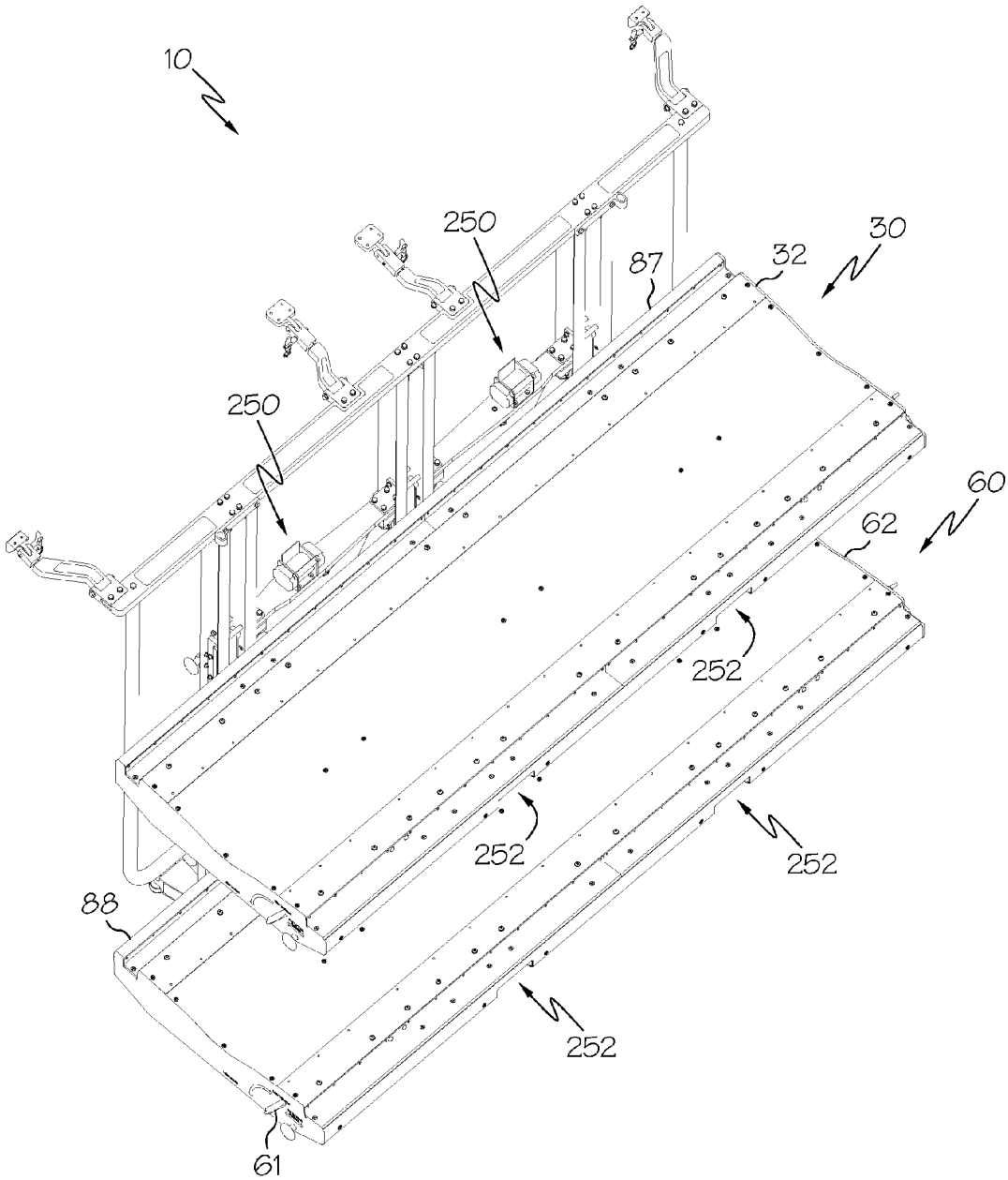
FIG. 8 is a front perspective view of the litter support system according to FIG. 4, wherein litter supports are rotated into a support position.

Optionally, the exemplary embodiment may include one or more inertial reels 250 for each litter support bed (e.g., upper litter bed 32 and lower litter bed 62) as shown in FIGS. 4 5, and 8. The inertial reels comprise a strap 254 wound around the inertial reel 250, which is spring-loaded reel. The strap

254 is biased by the spring-loaded reel toward a wound position, i.e., pulling the strap back into the inertial reel 250. When a patient-loaded litter 220 is placed upon one of the litter support beds (i.e., upper litter bed 32 or lower litter bed 62), the strap 254 from the inertial reel 250 is pulled from the reel and wrapped over the patient to a strap connection point 252 disposed on an outer side of the bed. As shown, the connection point may also be positioned at an underside of the outside of the bed. When a strap is connected to the connection point 252, the inertial reel 250 places the strap in tension, thus holding the patient securely on the litter 220.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A litter support system for a vehicle, comprising:

a plurality of vertical supports for attaching to a wall of the vehicle;

a plurality of base frames connected to respective lower ends of the plurality of vertical supports;

a plurality of upper biasing cylinders connected to respective ones of the plurality of vertical supports;

a plurality of lower biasing cylinders connected to respective ones of the plurality of base frames;

a plurality of upper connecting arms connected to respective ones of the plurality of vertical supports;

a plurality of lower connecting arms connected to respective ones of the plurality of vertical supports;

an upper litter bed for holding a litter, the upper litter bed connected to the plurality of upper connecting arms and the plurality of upper biasing cylinders; and a lower litter bed for holding a litter, the lower litter bed connected to the plurality of lower connecting arms and the plurality of lower biasing cylinders.

2. The litter support system according to claim 1, further comprising a litter securing device connected to each one of the upper and lower litter beds, each litter securing device movable to secure or unsecure a litter from the upper and lower litter beds.

3. The litter support system according to claim 1, wherein the upper and lower litter beds are connected to the plurality of vertical supports and base frames such that the upper and lower beds are substantially horizontally-movable between a first support position substantially near the plurality of vertical supports and a second support position extended outwardly from the plurality of vertical supports.

4. The litter support system according to claim 3, further comprising an inertial reel, a strap wound around the inertial reel, and a connection point on an outer side of a bed for receiving the strap.

5. The litter support system according to claim 3, wherein inner edges of the upper and lower beds are in a first position adjacent the plurality of vertical supports when the respective upper and lower beds are in the first support position, and wherein the inner edges move to a second position a distance away from the first position when the entire upper and lower beds are moved to the second support position.

* * * * *